US011382826B2

(12) United States Patent
Depow

(10) Patent No.: US 11,382,826 B2
(45) Date of Patent: Jul. 12, 2022

(54) MUTUAL STIMULATION DEVICE

(71) Applicant: Cocksure Toys Inc., Toronto (CA)

(72) Inventor: J. Charles Depow, Toronto (CA)

(73) Assignee: POW PRODUCT INC., Toronto (CA)

( * ) Notice: Subject to any disclaimer, the term of this patent is extended or adjusted under 35 U.S.C. 154(b) by 181 days.

(21) Appl. No.: 16/546,294

(22) Filed: Aug. 20, 2019

(65) Prior Publication Data

US 2019/0374426 A1 Dec. 12, 2019

Related U.S. Application Data

(63) Continuation of application No. 15/289,464, filed on Oct. 10, 2016, now Pat. No. 10,383,788.

(60) Provisional application No. 62/239,333, filed on Oct. 9, 2015.

(51) Int. Cl.

| | |
|---|---|
| ***A61H 19/00*** | (2006.01) |
| ***A61H 7/00*** | (2006.01) |
| ***A61H 23/00*** | (2006.01) |
| *A61H 23/02* | (2006.01) |

(52) U.S. Cl.

CPC ..... *A61H 19/32* (2013.01); *A61H 7/008* (2013.01); *A61H 23/00* (2013.01); *A61H 23/02* (2013.01); *A61H 2201/0103* (2013.01); *A61H 2201/0126* (2013.01); *A61H 2201/0138* (2013.01); *A61H 2201/0142* (2013.01); *A61H 2201/02* (2013.01); *A61H 2201/0257* (2013.01); *A61H 2201/1635* (2013.01); *A61H 2201/1645* (2013.01); *A61H 2201/1692* (2013.01)

(58) Field of Classification Search

CPC ..... A61H 19/00; A61H 19/30; A61H 19/32; A61H 19/50; A61H 23/00

See application file for complete search history.

(56) References Cited

U.S. PATENT DOCUMENTS

| | | | | |
|---|---|---|---|---|
| 8,157,723 | B2 * | 4/2012 | Nan | A61H 19/32 600/38 |
| 9,486,388 | B2 * | 11/2016 | Wright, Jr. | A61H 19/32 |
| 10,258,537 | B1 * | 4/2019 | Lamin | A61H 7/008 |
| 10,383,788 | B2 * | 8/2019 | Depow | A61H 19/32 |

* cited by examiner

*Primary Examiner* — John P Lacyk

(74) *Attorney, Agent, or Firm* — K&L Gates LLP

(57) ABSTRACT

A method of providing sexual stimulation between first and second penises includes the steps of providing a body including first and second openings on a front face, wherein first and second channels extend into the body from the first and second openings, respectively, along first and second longitudinal axes, respectively, that tend toward each other within the body, wherein the first and second channels partially merge to form a chamber; inserting a first penis and a second penis into each of the first and second openings, respectively, such that the penises contact each other within the chamber of the body; and inserting the penises further into the chamber such that the penises move along the respective longitudinal axes and contact the inside surface of the chamber such that an underside of each penis is in contact with the other.

17 Claims, 5 Drawing Sheets

MUTUAL STIMULATION DEVICE

CROSS-REFERENCE TO RELATED APPLICATIONS

This application comprises a continuation of U.S. application Ser. No. 15/289,464 filed Oct. 10, 2016, which incorporates by reference and claims the benefit of priority to U.S. Provisional Application 62/239,333 filed on Oct. 9, 2015, both of which are incorporated herein by reference.

BACKGROUND OF THE INVENTION

The present subject matter relates generally to a mutual stimulation device for the sexual intimacy of gay male couples. More specifically, the present invention relates to a mutual stimulation device to enhance the experience of male partners engaging in genital-to-genital rubbing.

For gay male couples, primary methods of sexual intimacy are oral and anal intercourse and mutual masturbation. Sometimes gay men also engage in a practice termed "frot", a specific type of mutual masturbation which refers to genital-to-genital rubbing, commonly with contact on the undersides of each partner's penis. This practice is logical given that the underside of the glans is often a sensitive area of a man's genitals, and that frot allows the stimulation of this area for both partners simultaneously. The other advantage of this practice is that it provides face-to-face sexual intimacy when anal intercourse is not desired or possible. And, because some gay men and certain subcultures within the gay community do not engage in anal intercourse at all, frot is an important practice to certain members of the gay community.

One challenge with frot is that often one partner must use his hand to hold the penises together in order to align them to achieve the desired contact. This is awkward and results in less than ideal body positions in order to accommodate the arm and hand. Often one partner needs to lie back reducing the possibility of face-to-face contact. Given that penises vary considerably in girth and length, the optimal alignment can also be difficult to achieve manually. Thus, there is a need for devices to improve the positioning and alignment of genitals during this form of sexual intimacy.

An additional challenge with frot is that it does not replicate the sensation of penetration. Therefore, there is a need for devices to provide the sensation of penetration while promoting and enabling frot.

Accordingly, there is a need for a mutual stimulation device, as described herein.

BRIEF SUMMARY OF THE INVENTION

To meet the needs described above and others, the present disclosure provides a mutual stimulation device for the sexual intimacy of gay male couples that properly aligns and supports each penis so that "frot" can be enjoyed and enhanced beyond what is possible manually.

In one embodiment, the mutual stimulation device is a hand-held device including an orifice for each partner. In other embodiments, the device may be body-mounted, furniture mounted, or otherwise stabilized. In some embodiments, the mutual stimulation device may be secured to a fixed object for enhanced stability, for example; the device may be mounted to a bed or wall. Each orifice is the opening of a channel that receives the genital of one of the users. The channels partially merge inside the mutual stimulation device to form an inner chamber that facilitates contact between the genitals of the users of the device while supporting and aligning their positions. The inside surfaces of the channels and the inner chamber may be textured (e.g., bumps, ridges, grooves, etc.) to enhance user pleasure.

In a first example, the mutual stimulation device is a molded silicone body held within a more rigid, but still soft, support sleeve of a material. The softness of the support sleeve is intended to promote comfort when the device lies against the body. The rigidity of the support sleeve resists the expansion of the silicone body when in use. This resistance to expansion improves the sensations experienced by users by ensuring sufficient contact and friction. For example, the silicone body may be a hardness of Shore 0015 (soft), and the support sleeve a hardness of Shore 0050 (more rigid, but still expandable and soft). This construction may be in contrast to adult novelty products on the market today that involve penetrating a very soft, unsupportive material (to replicate a skin-like feel) that is held together by a hard shell; the hard shell being uncomfortable against the body and would not allow for any expansion that allows for the accommodation of two penises of various thicknesses.

In one example, the molded silicone body and sleeve may be formed by injection molding. In another example, they may be formed through compression molding. In another example, the body and sleeve may be formed by 3-D printing a mold into which liquid silicone may be poured to cast the molded silicone. Although in the primary embodiment the body and support sleeve are molded silicone, in other embodiments the device may be constructed of other materials such as rubber, elastomeric gels, or any other structural material. In this example, the device is made of material sufficiently elastic to accommodate a wide range of penis sizes while maintaining a snug fit, yet firm enough so that each genital is kept in its intended alignment.

No matter the materials used in its construction, the shape of the body of the device (and its corresponding outer sleeve if present) may be any shape that facilitates the objectives described herein, including: rectangular, cylindrical, spherical, etc.

Some of the objects of this invention include providing gay partners: (1) an alternative to anal intercourse when they desire the sensation of penetration with face-to-face sexual intimacy; and (2) an easy way to enjoy simultaneous genital stimulation. Other objectives may include providing a means for safer sex (i.e., no penetration of either partner) and increasing access to alternative means of physical intimacy between gay, bi-sexual, and/or any other form of sexually intimate couple.

In a primary example of the mutual sexual stimulation device, the orifices are positioned to allow each partner to penetrate one face of the device while positioned on opposing sides of the face at an angle that accommodates the natural upward angle of an erection, while positioning the underside of each penis in contact with the other; which provides face-to-face intimacy. In order to replicate the feeling of pentation, the device may include separate entry points for each penis to stimulate a feeling of penetrating an orifice. Each channel then opens up into a shared chamber that facilitates physical contact while maintaining the proper positions of each penis.

In one example a mutual sexual stimulation device includes: a body including two offset channels, each channel sized to accept or expand to accept male genitalia, wherein the channels are aligned such that, when male genitalia is located within each channel, at least a portion of each of the male genitalia is in contact with the other.

The body of the mutual sexual stimulation device may be nearly any shape and made from a wide range of materials, including, preferably, silicone. The body may be a molded one-piece construction or may include multiple pieces.

The openings to the mutual sexual stimulation device may each be found in a front face of the device. In other versions, the openings may be in two or more faces of the body, separated by a lesser or greater distance and at a greater or lesser angle to each other. For example, in some embodiments, a longitudinal axis of each offset channel intersects a longitudinal axis of the other offset channel, wherein an angle formed between the longitudinal axes by the intersection of the longitudinal axes is between 0 and 30 degrees. In other embodiments, the angle formed between the longitudinal axes by the intersection of the longitudinal axes is between 5 and 15 degrees. In a preferred embodiment, the angle formed between the longitudinal axes by the intersection of the longitudinal axes is 8 degrees.

In another example, the body includes a first face and a second face, wherein the first face includes an opening to a first channel and the second face includes an opening to a second channel. In a preferred arrangement, the first face and second face are generally located on the same end of the body.

In some versions, the interior surfaces of the two offset channels includes surface texture. Further, in one example, the approximate shape of each of the openings is circular and, as the openings lead to their respective channels that merge to form the single chamber, the chamber takes the form of a figure eight (i.e., lemniscate) shape. In another example, the two openings overlap such that the openings themselves form a single lemniscate shaped opening along a front face of the body and the lemniscate shape continues through the channels and into the chamber, with the interior surfaces of the channels and chamber converging to facilitate contact between the penises.

In another example, a method of sexual intimacy includes the steps of: providing a mutual sexual stimulation device including a body including two channels, each channel sized to accept male genitalia, wherein the channels are aligned such that, when male genitalia is located within each channel, at least a portion of each of the male genitalia is in contact with the other; and inserting a penis into each of the offset channels such that the penises contact each other within a chamber of the body and do not contact each other immediately adjacent an opening on a front face of the device. In this method, the body of the mutual sexual stimulation device includes two adjacent openings each opening leading to a respective one of the two channels that lead to the internal chamber. In another example, the body of the mutual sexual stimulation device includes a single lemniscate opening leading to the lemniscate channels and chamber.

An advantage of the invention is that it provides an easy-to-use, easy-to-clean, mutual stimulation device that may be used for sexual intimacy. The device is made from materials that may be cleaned by hand or materials that may be cleaned in a dishwasher and is straightforward in design and function.

Additional objectives, advantages and novel features of the examples will be set forth in part in the description which follows, and in part will become apparent to those skilled in the art upon examination of the following description and the accompanying drawings or may be learned by production or operation of the examples. The objectives and advantages of the concepts may be realized and attained by means of the methodologies, instrumentalities and combinations particularly pointed out in the appended claims.

BRIEF DESCRIPTION OF THE DRAWINGS

Drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
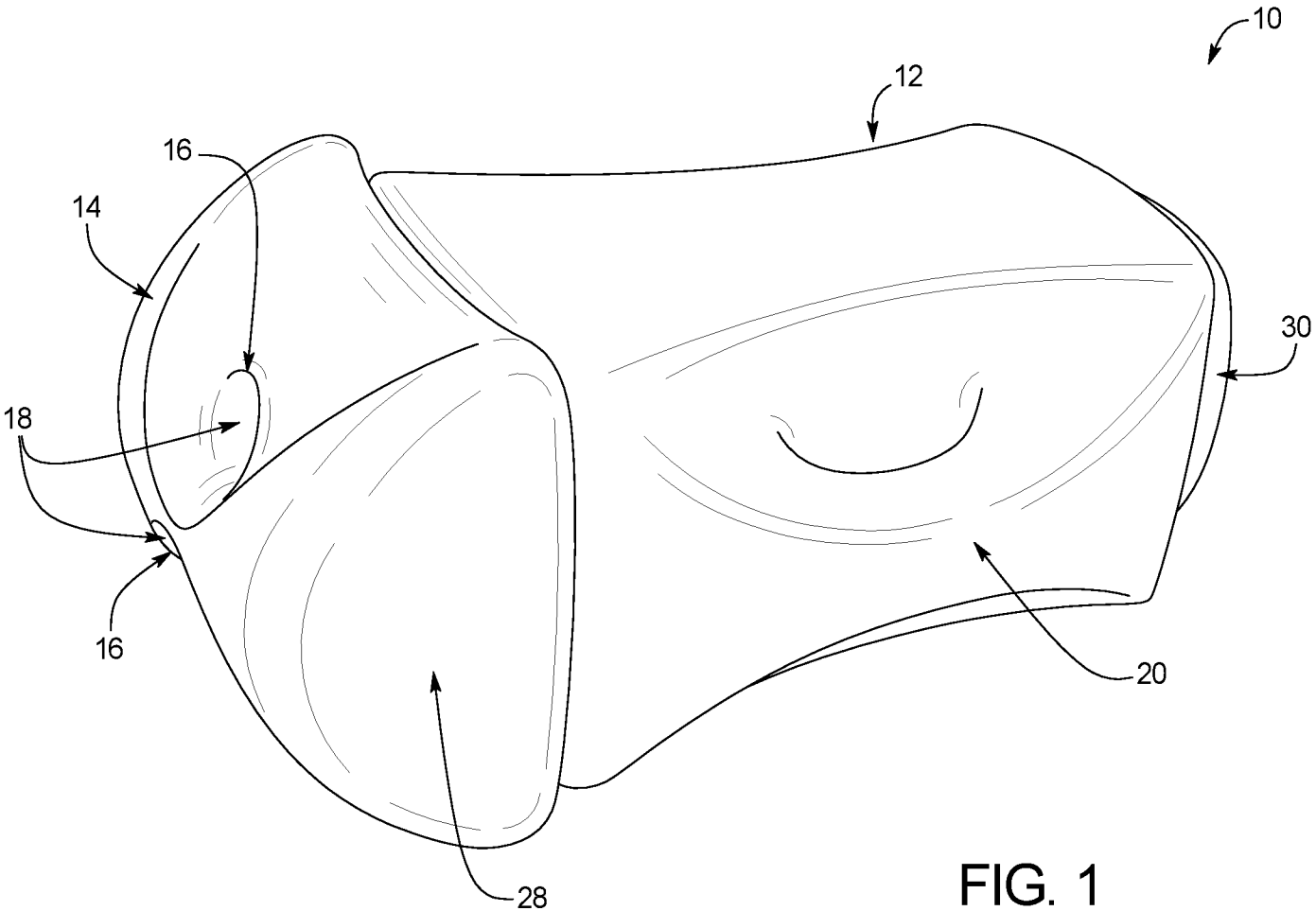
FIG. 1 is an isometric view of an example of a mutual sexual stimulation device.
Figure 2:
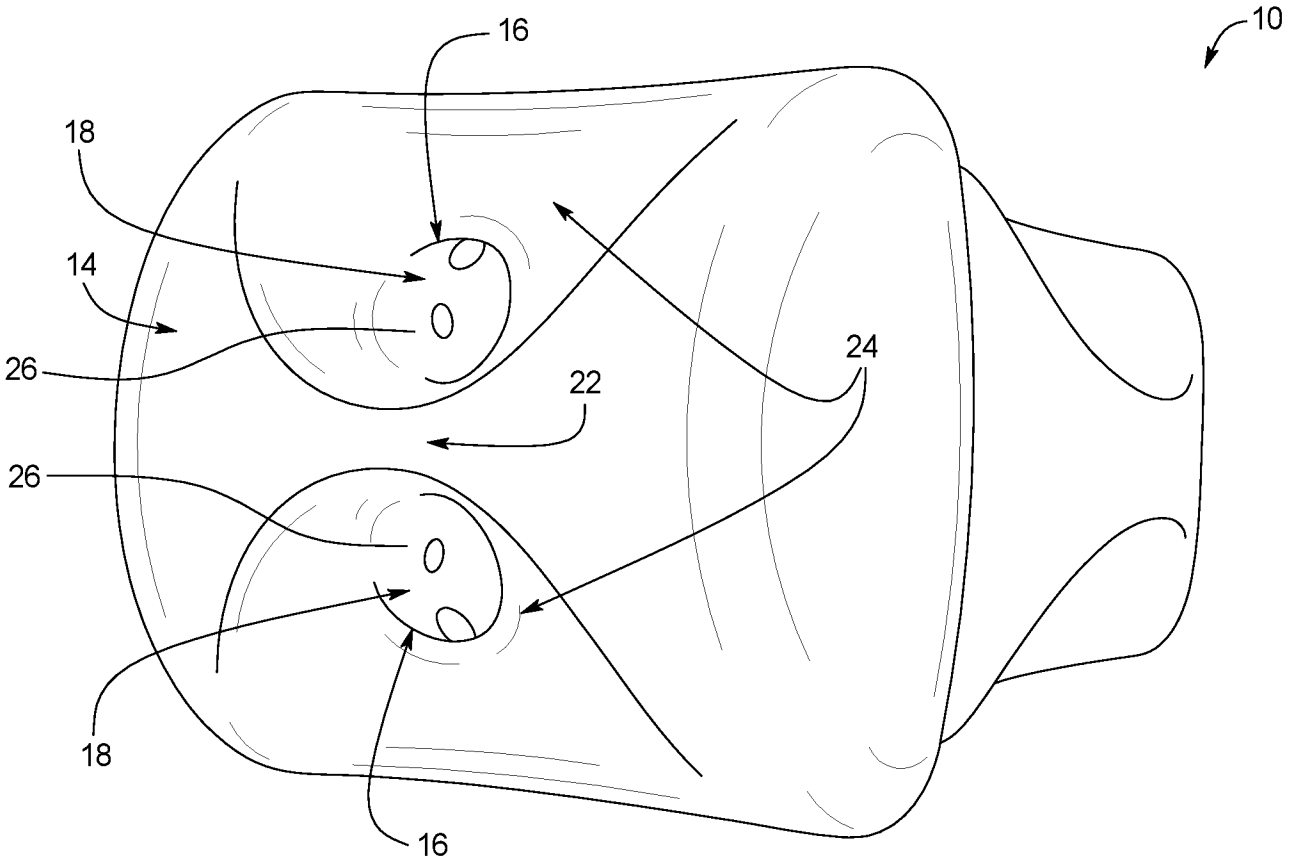
FIG. 2 is another isometric view of the mutual sexual stimulation device shown in FIG. 1.

FIGS. 1 and 2 illustrate an example of a mutual sexual stimulation device 10 embodying the objectives and advantages described herein. In the example shown in FIGS. 1 and 2, the mutual sexual stimulation device 10 includes a molded, one-piece, silicone body 12, including a front face 14 in which a pair of offset, adjacent openings 16 are located. The openings 16 lead to a pair of channels 18 that converge to a chamber 32 (FIG. 3) that runs internally along the length of the body 12, as described further herein. A rear face 30 includes a third opening 34 (FIGS. 3 and 4A-4C). The body 12 may further include one or more handles 20 or other gripping mechanisms to improve the users' ability to position and manipulate the device in use.

Although shown as a one-piece, silicone body 12, the mutual sexual stimulation device 10 can be made from any one or more materials appropriate for use as a sexual aid. The preferred material is medical-grade, chemically inert silicone, which is hypoallergenic and safe for use as described herein. It is a non-porous material that is easy to clean and does not wear out easily. It is a strong, dense material, but it also warms to body heat, which may be more comfortable and natural feeling for the users than other suitable materials may be. However, it is contemplated that one or more portions of the mutual sexual stimulation device 10 may be formed from one or more thermoplastic elastomers, soft plastics, rubbers, and the like. For instance, in the example shown in FIG. 3, the mutual sexual stimulation device 10 is a two-piece construction that includes an outer sleeve 36 surrounding the silicone body 12. The outer sleeve 36 may be made from a different material as the body 12, for example, a more rigid material (or a more rigid formulation of the same material) to provide support and structure to the device 10 and improve the stability of and compression of the penises within the chamber 32. Similarly, the embodiment shown in FIG. 1 may be a two-piece construction, with the portion of the mutual sexual stimulation device 10 including the handles 20 being a part of the outer sleeve 36 and the body 12 being the portion of the mutual sexual stimulation device within the outer sleeve 36.

In addition, one or more portions of the body 12 or sleeve 36 may be formed from materials incorporating water-filled cavities, gel-filled cavities, air-filled cavities, and the like. Similarly, the mutual sexual stimulation device 10 may incorporate one or more vibrating motors to enhance the sensations experienced in using the device. Between variations in materials and construction techniques, such as including water-filled cavities, the stretching, compression, heat regulation, and other physical characteristics of the device 10 may be adapted to meet a wide range of personal preferences.

Figure 3:
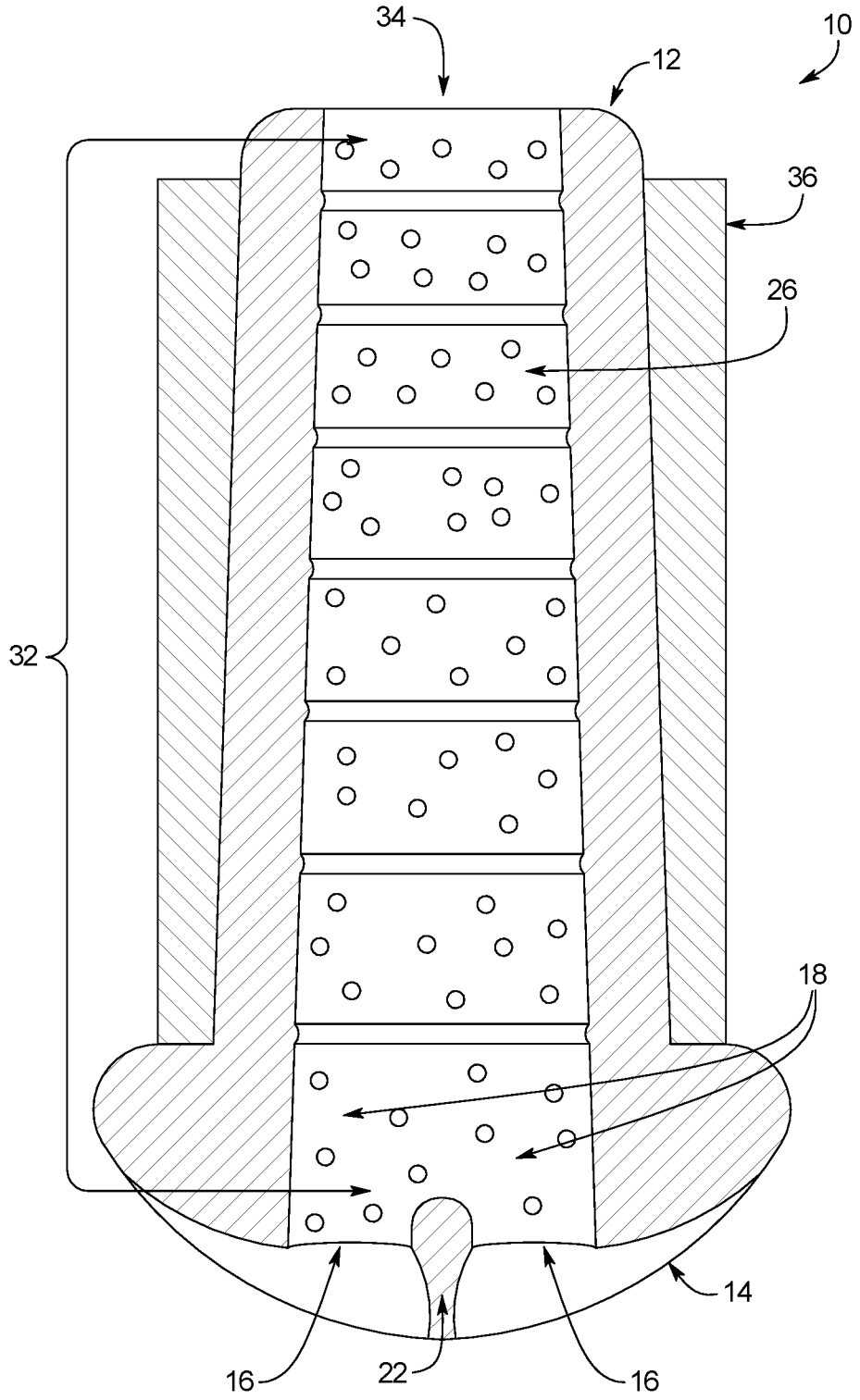
FIG. 3 is a cross-sectional side view of another example of the mutual sexual stimulation device shown in FIG. 1.

As shown in FIG. 2, the openings 16 lead to channels 18 and each opening 16 provides an entry point for a penis. The openings 16 in this embodiment are separated by a barrier 22 that spaces the openings 16 and provides isolation between the channels 18 near the openings 16, but partially merge further inside the body to form the chamber 32 (FIG. 3). The openings 16 are located in contoured, recessed receiving areas 24 of the body 12, that provide space for a user to comfortable fit close against the mutual sexual stimulation device 10. The channels 18 shown have textured interior surfaces 26; in this example, raised bumps. Although shown as bumps, the interior surfaces 26 may include and combination of rings, ribs, ridges, channels, beads, bristles, and the like. Alternatively, the interior surfaces 26 may be smooth and non-textured.

In the embodiment shown in FIGS. 1 and 2, the face 14 of the body 12 is designed for penetration includes generally smooth and rounded features, which helps to make the device 10 more comfortable to the users, though the mutual sexual stimulation device 10 may be embodied in a variety of shapes, including generally rectangular, ovular, spherical, and on. Additionally, the embodiment shown in FIGS. 1 and 2 may be made of one integral piece of material (e.g., silicone) or from two separate materials (e.g., a silicone body 12 and thermoplastic elastomer outer sleeve 36).

Turning to FIG. 3, a cross-sectional view of the mutual sexual stimulation device 10 details one example of the internal form. The embodiment shown in FIG. 3 is a two-piece mutual sexual stimulation device 10, including a body 12 and an outer sleeve 36. By employing a multi-piece device 10, varied materials can be used for the body 12 and the outer sleeve 36 to enhance the respective properties of each. For example, the body 12 may be made from a softer and more elastic material to improve comfort, while the outer sleeve 36 is formed from a less soft (though still comfortable for use against the body) and less elastic material to resist the expansion of the inner body 12 and to improve compression within the chamber 32. As additionally shown, the outer sleeve 36 is thicker to provide more rigidity and compression in the section of the body 12 where the penis heads rub together. Comfort and other performance variables may be intentionally affected by varying the thicknesses and the materials of the device 10.

As shown in FIG. 3, the interior surfaces 26 the channels 18 are textured along their lengths. The textured interior surfaces 26 include both ridges and bumps. In addition, it is easy to see in this view that longitudinal axis of each of the offset channels 18 are furthest apart at the openings 16 and converge along the length of the mutual sexual stimulation device 10 (i.e., the channels angle towards each other as they approach the third opening 34). The angle between longitudinal axis of each channel 18 shown in FIG. 3 is approximately 8 degrees (i.e., each channel 18 is at an angle of approximately 4 degrees with respect to the centerline of the device 10). However, it is contemplated that the arrangement of the openings 16 may be adapted such that the angle may be any of a wide range of angles. For example, in some instances, the angle may be anywhere between 0 degrees and 30 degrees. In other examples, the angle may be anywhere between 5 degrees and 15 degrees.

The barrier 22 spaces the openings 16 and the channels 18, but only for a short distance into the body 12 at which point the two channels 18 converge into a single chamber 32 in which, in use, the underside of each users' penis contacts the underside of the other user's penis, especially towards the head of each penis. One advantage of the barrier 22 is that it helps facilitate a feeling of penetration as each user enters the device 10. In this example, the barrier 22 extends into the body 12 approximately one inch, providing stability to the openings 16, separation of the channels 18 near the openings 16, but without interfering with the contact between penises further in the chamber 32. However, it is contemplated that the barrier 22 may extend a greater or lesser distance into the body 12. For example, in some embodiments, the barrier 22 may extend between one quarter of an inch to two inches into the body 12.

In the embodiment shown in FIG. 3, the converging channels 18 approximately form a figure eight, or lemniscate, shape. This lemniscate shape helps to keep the penises aligned and in contact, specifically to promote contact along the underside of the head of each penis. In other examples of the mutual sexual stimulation device 10, the entire length of the channels 18 may be a lemniscate shape, including the openings 16, which in that embodiment would appear to be a single opening 16. As further shown, FIG. 3 shows that there is a third opening 34 in the body 12, as discussed further below.

In an embodiment of the mutual sexual stimulation device 10, the body 12 is approximately 7.25 inches in length with channel diameters of approximately two-thirds of an inch near the openings 16 and tapering to smaller diameters away from the openings 16 and into the chamber 32. The reduction in diameter is intended to increase the compressive forces on the penises in the chamber 32. Variations of the dimensions may be used. In fact, various sizes of the mutual sexual stimulation device 10 may be provided to more closely match the anatomy of the users. In one contemplated example, the mutual sexual stimulation device 10 is custom made to match the dimensions provided by the users (e.g., one channel is a different size than the other). As such, each opening 16 and each channel 18 may be a unique size. In addition, the openings 16 may be staggered at various depths in the body 12 to assist in aligning the heads of the penises in use.

Figure 4A:
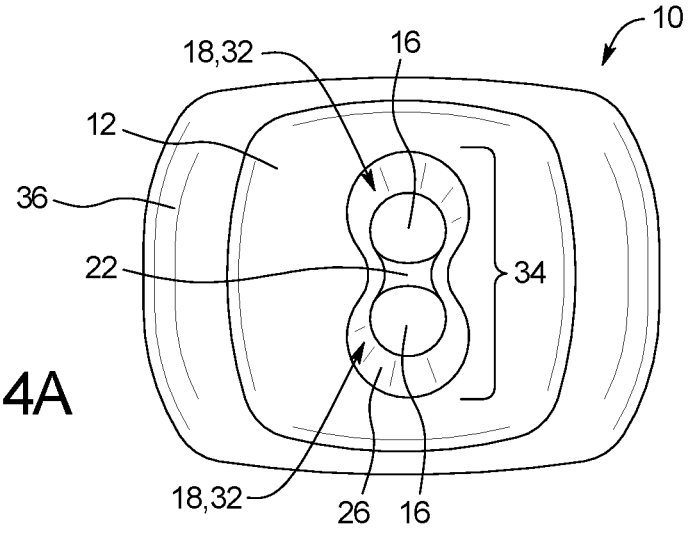
FIG. 4A-4C are back side views of examples of a mutual sexual stimulation device.
Figure 4B:
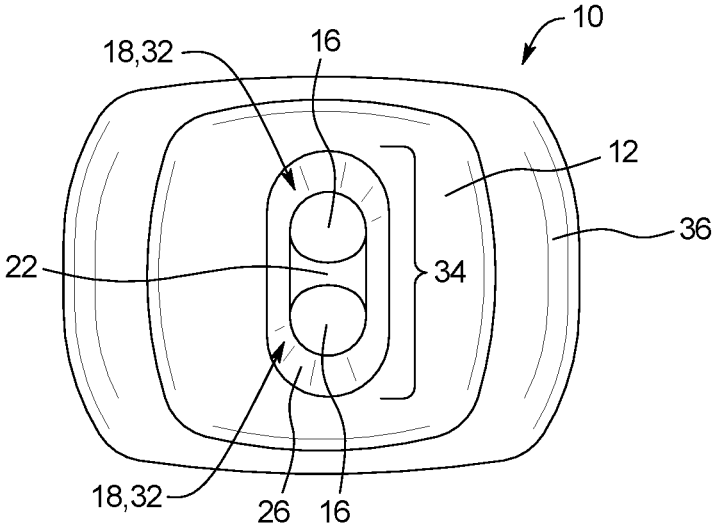
Figure 4C:
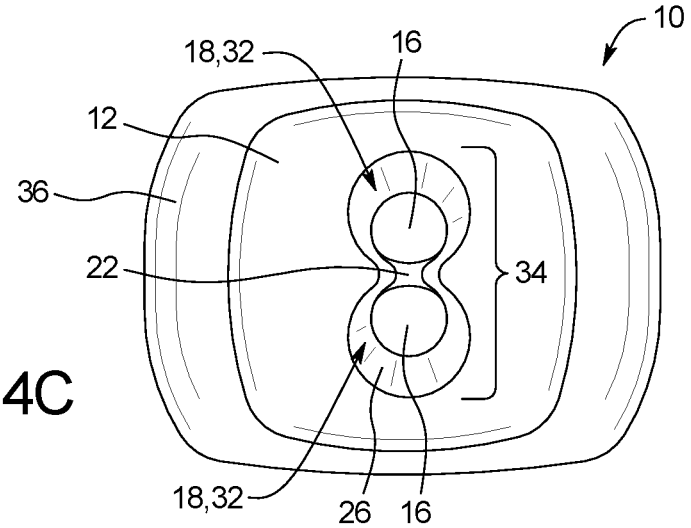

FIGS. 4A-4C show variations of a two-piece embodiment of the mutual sexual stimulation device 10. As shown in FIG. 4, the body 12 of the device 10 includes channels 18 that extend through the entire length of the body 12 partially merging to provide a third opening 34 opposite of the openings 16 and the barrier 22 along the front face 14. The third opening 34 is useful for allowing semen, lubricant, and other substances to escape the body 12 and/or for the chamber 32 to be more easily cleaned. The third opening 34 may also help to prevent the formation of a low-pressure vacuum when the device 10 is in use and permit the easy application of lubricant.

FIGS. 4A-4C provide views that help to illustrate the point that more the interior surfaces 26 "pinch in" to create a figure eight shape in the chamber 32 the greater the positional stability of the genitalia in the chamber 32, and the less the interior surfaces 26 "pinch in" to create a figure eight shape in the chamber 32 the more room there is for contact between the genitals. FIG. 4B demonstrates an embodiment of the device 10 which has no "pinch in," with the chamber 32 forming a more ovular shape. Such a chamber 32 shape enables greater contact between user's genitals at the cost of positional stability. FIG. 4C illustrates yet another embodiment of the device, this time with the interior surfaces 26 highly "pinched in" (i.e., more pinched in than what is seen in FIG. 4A). This embodiment increases positional stability and reduces overall genital contact. As shown, variations in the shape of the chamber 32 may be used to optimize the performance of the device 10. In addition, the amount of pinching and the size of the chambers during use of the product will depend, at least in part, on the girth of the penises in the device and how much they cause the chamber 32 to expand.

As further shown in FIGS. 4A-4C, the body 12 is intentionally thicker on the sides of the body 12 than the top and bottom. The thickness further helps with the stability of the penises in the chamber 32 by keeping them aligned and maximizing contact. This is one reason that the mutual sexual stimulation device 10 may preferably be "block-shaped." Another reason the mutual sexual stimulation device 10 may preferably be a block shape is that having flat sides lie against each partners's body in use prevents the device 10 from rolling.

Figure 5:
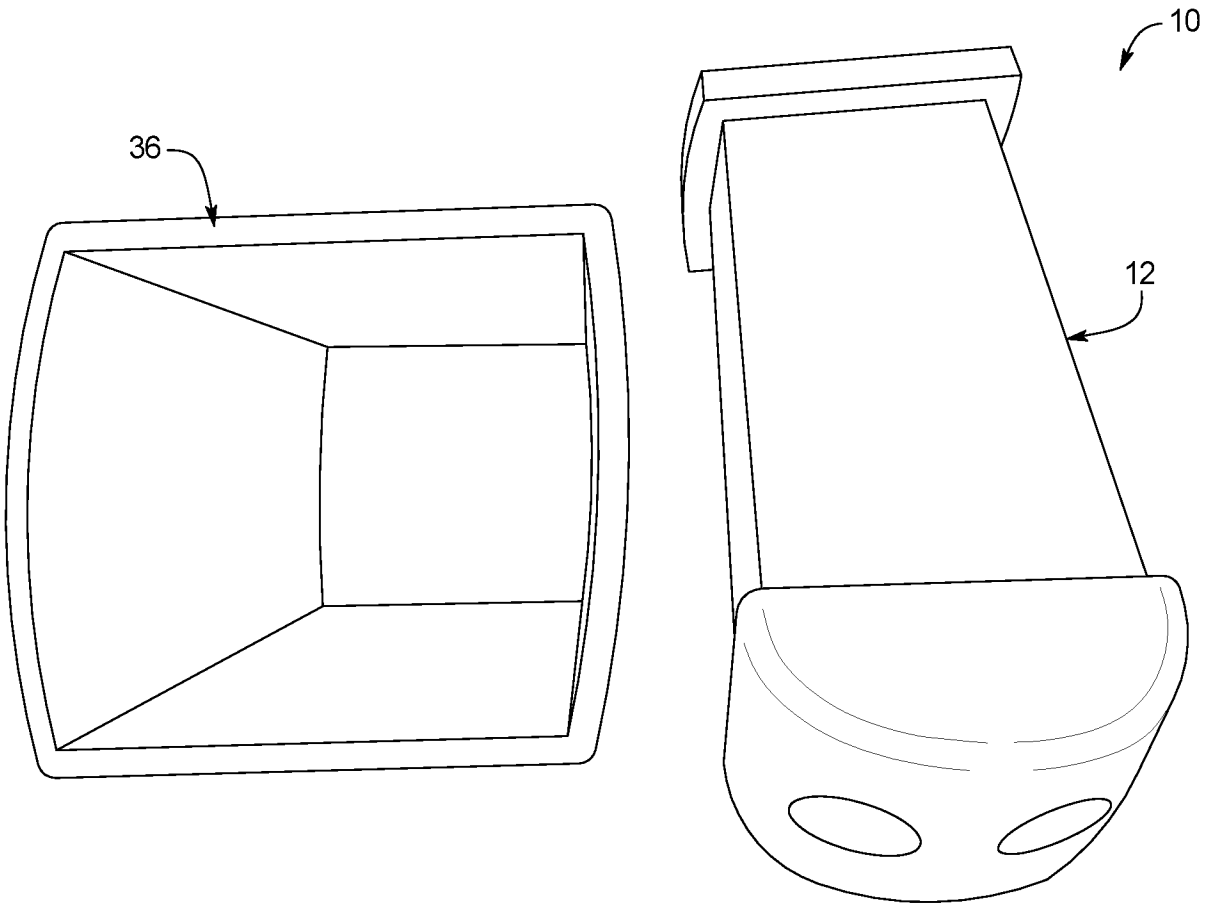
FIG. 5 is an isometric view of a main body and an outer sleeve of another example of a mutual sexual stimulation device.

FIG. 5 shows another example of a mutual sexual stimulation device 10. In the example shown in FIG. 5, an outer sleeve 36 forms a second piece of a two-piece embodiment of the mutual sexual stimulation device 10. As shown in FIG. 5, the outer sleeve 36 may be a more rigid material that surrounds the body 12 providing greater compression for the penises, as described above. In this embodiment, the body 12 may be made from a softer and more elastic material, while the outer sleeve 36 is formed from a less soft (though still comfortable for use against the body) and less elastic material to improve compression. In another embodiment, the sleeve's inner wall may also form a figure eight to increase the positional stability of the penises.

It can be seen through a comparison of FIGS. 3-5 that the thickness and shape of the outer sleeve 36 may vary. For example, the outer sleeve 36 is thicker in FIGS. 3-4C than the outer sleeve 36 shown in FIG. 5. It will be understood based on the descriptions and drawings provide herein that the proportions and shape of the body 12 and the outer sleeve 36 may take many forms.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A method of providing sexual stimulation between first and second penises, the method comprising the steps of:

providing a body including first and second openings on a front face, wherein first and second channels extend into the body from the first and second openings, respectively, along first and second longitudinal axes, respectively, that tend toward each other within the body, wherein the first and second channels partially merge to form a chamber, wherein the chamber has a lemniscate shape about the first and second longitudinal axes;

inserting the first penis and the second penis into each of the first and second openings, respectively, such that the first and second penises contact each other within the chamber of the body and do not contact each other immediately adjacent the openings on the front face of the body; and inserting the first and second penises further into the chamber such that the first and second penises move along the respective longitudinal axes and contact the inside surface of the chamber, the lemniscate shape of the chamber providing alignment of the first and second penises such that an underside of each penis is in contact with the other.

2. A method of providing sexual stimulation between first and second penises of first and second users, respectively, the method comprising the steps of:

providing a mutual sexual stimulation device including a body including;

first and second openings on a front face, wherein first and second channels extend into the body from the first and second openings, respectively, along first and second longitudinal axes, respectively, toward first and second internal ends, respectively;

wherein the first and second longitudinal axes tend toward each other within the body, and wherein first and second diameters of the first and second channels, respectively, taper along the first and second longitudinal axes, respectively, toward the chamber to increase compressive forces on the first and second penises; and wherein the first and second channels partially merge to form a chamber adjacent to the first and second internal ends, respectively; and inserting the first penis and the second penis into each of the first and second openings, respectively, such that the first and second penises contact each other within the chamber of the body; and inserting the first and second penises further into the chamber such that the first and second penises move along the respective longitudinal axes and contact the inside surface of the chamber such that an underside of each penis is in contact with the other.

3. The method of claim 2, further including the step of separating the first penis and the second penis by a barrier adjacent to the openings.

4. The method of claim 2, wherein the body of the mutual sexual stimulation device has a block shape including first and second opposing flat surfaces, and further comprising the step of positioning the first and second flat surfaces against a first body and a second body, respectively, of the first user and the second user, respectively.

5. A mutual sexual stimulation device for receiving and aligning first and second undersides of first and second male genitalia, the mutual sexual stimulation device comprising:

a body including first and second openings on a front face, wherein first and second channels extend into the body from the first and second openings, respectively, along first and second longitudinal axes, respectively, toward first and second internal ends, respectively;

wherein the first and second longitudinal axes tend toward each other within the body;

wherein the first and second channels partially merge to form a chamber adjacent to the first and second internal ends, respectively; and wherein first and second diameters of the first and second channels, respectively, taper along the first and second longitudinal axes, respectively, toward the chamber to increase compressive forces on the first and second male genitalia.

6. The mutual sexual stimulation device of claim 5, wherein the body is a thermoplastic elastomer.

7. The mutual sexual stimulation device of claim 5, wherein the body is silicone.

8. The mutual sexual stimulation device of claim 5, wherein the body is one-piece.

9. The mutual sexual stimulation device of claim 5, further including an outer sleeve surrounding a portion of the body.

10. The mutual sexual stimulation device of claim 9, wherein the body comprises a first material and the outer sleeve comprises a second material that is more rigid than the first material.

11. The mutual sexual stimulation device of claim 10, wherein the first material is silicone.

12. The mutual sexual stimulation device of claim 5, wherein an angle formed between the first and second longitudinal axes by the intersection of the longitudinal axes is between 5 and 15 degrees.

13. The mutual sexual stimulation device of claim 5, wherein an inner surface of the chamber includes surface texture.

14. The mutual sexual stimulation device of claim 5, further including a third opening at a second end of the chamber.

15. The mutual sexual stimulation device of claim 5, wherein the tapering of the first and second diameter of the first and second channels, respectively, increases friction near the glans of the respective male genitalia.

16. The mutual sexual stimulation device of claim 15, wherein the first and second longitudinal axes tending toward each other increases friction near the glans of the respective male genitalia.

17. The mutual sexual stimulation device of claim 5, wherein the body has a block shape including first and second opposing flat surfaces.

* * * * *